US011322320B2

(12) United States Patent
Cheng

(10) Patent No.: US 11,322,320 B2
(45) Date of Patent: May 3, 2022

(54) SWITCH

(71) Applicant: ANHUI ONESKY ELECTRIC TECH. CO. LTD, Anhui (CN)

(72) Inventor: Lina Cheng, Anhui (CN)

(73) Assignee: ANHUI ONESKY ELECTRIC TECH. CO. LTD., Anhui (CN)

( * ) Notice: Subject to any disclaimer, the term of this patent is extended or adjusted under 35 U.S.C. 154(b) by 0 days.

(21) Appl. No.: 17/055,925

(22) PCT Filed: Feb. 14, 2019

(86) PCT No.: PCT/CN2019/075012
§ 371 (c)(1),
(2) Date: Nov. 16, 2020

(87) PCT Pub. No.: WO2020/143096
PCT Pub. Date: Jul. 16, 2020

(65) Prior Publication Data

US 2021/0159034 A1 May 27, 2021

(30) Foreign Application Priority Data

Jan. 8, 2019 (CN) ..... 201910015967.X

(51) Int. Cl.
*H01H 33/04* (2006.01)
*H01H 33/42* (2006.01)
*H01H 33/53* (2006.01)

(52) U.S. Cl.
CPC ..... *H01H 33/04* (2013.01); *H01H 33/42* (2013.01); *H01H 33/53* (2013.01)

(58) Field of Classification Search
CPC ..... H01H 33/04; H01H 33/42; H01H 33/53; H01H 33/285; H01H 33/28; H01H 33/666;
(Continued)

(56) References Cited

U.S. PATENT DOCUMENTS 9,183,996 B2 * 11/2015 Karlstrom ..... H01H 33/666
9,659,727 B2 * 5/2017 Kanaya ..... H01H 33/143
(Continued)

FOREIGN PATENT DOCUMENTS

CN 101315836 A 12/2008
CN 102082044 A 6/2011
(Continued)

OTHER PUBLICATIONS

Translation of CN107833783(original document published Mar. 23, 2018) (Year: 2018).*
(Continued)

*Primary Examiner* — William A Bolton
(74) *Attorney, Agent, or Firm* — Kenealy Vaidya LLP

(57) ABSTRACT

Embodiments provide a switch, including a control system, first and second manipulating mechanisms. The control system emits an operating instruction to the second manipulating mechanism when the wire works normally, the operating instruction instructing the second manipulating mechanism to perform an opening action or a closing action; the control system emits a first and second action instructions to the first and second manipulating mechanisms, respectively, when the wire fails, the first action instruction instructing the first manipulating mechanism to perform a first action, and the second action instruction instructing the second manipulating mechanism to perform a second action, the cooperative action between the first manipulating mechanism and the second manipulating mechanism implements redundancy of the switch operating; and the time taken by the first manipulating mechanism to implement the first action is different from the time taken by the second manipulating mechanism to implement the second action.

18 Claims, 3 Drawing Sheets

(58) Field of Classification Search
CPC ..... H01H 33/6662; H01H 71/12; H01H 71/1081; H01H 71/2454
USPC ..... 218/146, 118, 120, 134, 139, 140, 153, 218/154
See application file for complete search history.

(56) References Cited

U.S. PATENT DOCUMENTS

| | | | | |
|---|---|---|---|---|
| 9,905,348 | B2 * | 2/2018 | Kim | H01H 33/6662 |
| 9,911,562 | B2 * | 3/2018 | Bissal | H01H 33/38 |
| 10,032,589 | B2 * | 7/2018 | Bachmaier | H01H 51/27 |
| 2006/0164097 | A1 | 7/2006 | Zhou et al. | |
| 2016/0099123 | A1 * | 4/2016 | Ohda | H01F 7/08 335/170 |

FOREIGN PATENT DOCUMENTS

| | | | |
|---|---|---|---|
| CN | 107068504 | A | 8/2017 |
| CN | 107833783 | A | 3/2018 |

OTHER PUBLICATIONS

Sep. 26, 2019 International Search Report (ISR) issued in PCT Patent App. No. PCT/CN2019/075012 (in English).
Sep. 26, 2019 Written Opinion of the International Searching Authority (WO) issued in PCT Patent App. No. PCT/CN2019/075012 (in English).

* cited by examiner

SWITCH

CROSS REFERENCE TO RELATED APPLICATION(S)

This application is a national phase filing under 35 C.F.R. § 371 of and claims priority to PCT Patent Application No. PCT/CN2019/075012, filed on Feb. 14, 2019, which claims the priority benefit under 35 U.S.C. § 119 of Chinese Patent Application No. 201910015967.X, filed on Jan. 8, 2019, the contents of each of which are hereby incorporated in their entireties by reference.

BACKGROUND

Some embodiments of the present disclosure generally relate to the field of power supply and distribution, and more particularly relate to a switch.

Expeditious development of industrialization and urbanization boosts a continuous growth of power demands in a long run, which poses a heavy and complicated task on grid development; therefore, it is particularly urgent to build up a robust smart grid. Currently, the smart grid is developing towards extra-high voltage and ultra-high voltage, and developing high-performance and high-reliability circuit breakers matched thereto may provide a strong technical support to the security and reliability for power supply of smart grids.

A circuit breaker is a switch, which may close, carry, and break current in a normal loop condition and may close, carry and break current under abnormal loop conditions within a specified time. The circuit breaker may be applied to distribute electrical energy without the asynchronous motor being actuated frequently, thereby protecting the power supply wire and the motor; besides, the circuit breaker may automatically cut off the electrical circuit in case of serious overload, short circuit, and undervoltage.

Studies show that when a fault occurs to an electrical circuit, an upstream circuit breaker is generally opened to clear the fault. However, the opening action is slow. If the fault is cleared within 30 ms~40 ms after the occurrence of arc fault, the voltage sensitivity load will be shut down (e.g., a variable-frequency speed-governing device), which will incur a severe economic loss to users; besides, serious damages to a system transformer and a fault point may be caused. Further, faults sometimes occurring to medium-voltage circuit breakers are mostly caused by breaker operation failure. Incomplete statistics show that in 2016, more than 85% of medium-voltage circuit breaker faults were caused by breaker operation failure. The causes include: mechanism deadlock, crash of the control part, short circuit of the control loop, and failure of energy-storage motor, etc.

SUMMARY

Some embodiments of the present disclosure provide a switch that may lower the odds of occurrence of circuit breaker operation failures and enhance security of a smart grid system.

Some embodiments of the present disclosure provide a switch, including a control system, a first manipulating mechanism, and a second manipulating mechanism, wherein:

the control system emits a first action instruction to the first manipulating mechanism, and a second action instruction to the second manipulating mechanism, respectively;

and wherein the first action instruction is configured for instructing the first manipulating mechanism to perform a first action;

the second action instruction is configured for instructing the second manipulating mechanism to perform a second action; and the time taken by the first manipulating mechanism to implement the first action is different from the time taken by the second manipulating mechanism to implement the second action.

Some other embodiments of the present disclosure provide a switch, including: a control system, a first manipulating mechanism, and a second manipulating mechanism, wherein:

the control system emits an action instruction to the first manipulating mechanism and the second manipulating mechanism, respectively;

and wherein the action instruction is configured for instructing the first manipulating mechanism to perform a first action; then, the second manipulating mechanism performs a second action;

the time taken by the first manipulating mechanism to implement the first action is different from the time taken by the second manipulating mechanism to implement the second action.

Some embodiments of the present disclosure may achieve the following advantageous effects:

Some embodiments of the present disclosure provide a switch, including a control system, a first manipulating mechanism, and a second manipulating mechanism, wherein the control system emits a first action instruction to the first manipulating mechanism and a second action instruction to the second manipulating mechanism, respectively; the first action instruction being configured for instructing the first manipulating mechanism to perform a first action, and the second action instruction being configured for instructing the second manipulating mechanism to perform a second action; and the time taken by the first manipulating mechanism to implement the first action is different from the time taken by the second manipulating mechanism to implement the second action. According to the solution provided in some embodiments of the present disclosure, by adopting a control system that may control different manipulating mechanisms, opening-closing actions at different speeds may be implemented, short-circuit accidents occurring in a grid may be promptly cleared, and grid operating stability may be improved; with cooperative actions between the first manipulating mechanism and the second manipulating mechanism to make the switch operating redundant, so that the odds of switch operation failure may be effectively lowered, and security of the whole smart grid system may be enhanced.

BRIEF DESCRIPTION OF THE DRAWINGS

To elucidate the technical solutions of some embodiments of the present disclosure, the drawings used in describing the embodiments will be briefly introduced below. It is apparent that the drawings as described only relate to some embodiments of the present disclosure. To those of ordinary skill in the art, other drawings may be derived based on these drawings without exercise of inventive work, wherein.

DETAILED DESCRIPTION OF EXEMPLARY EMBODIMENTS

In practical applications, circuit breakers may be divided into fast circuit breakers and typical circuit breakers. A typical circuit breaker has a slow opening action. A fast circuit breaker has a relatively motion intensity when being opened and closed as it is mainly actuated by an electromagnetic repulsion mechanism, so that a long-term use thereof tends to cause fatigue and damage, thereby shortening the service life of the whole equipment and lowering the security of the smart grid system.

To make the objects, technical solutions, and advantages of the present disclosure much clearer, some embodiments of the present disclosure provide a switch, including a control system, a first manipulating mechanism, and a second manipulating mechanism, wherein the control system emits a first action instruction to the first manipulating mechanism and a second action instruction to the second manipulating mechanism, respectively; the first action instruction being configured for instructing the first manipulating mechanism to perform a first action, and the second action instruction being configured for instructing the second manipulating mechanism to perform a second action; and the time taken by the first manipulating mechanism to implement the first action is different from the time taken by the second manipulating mechanism to implement the second action. According to the solution provided in some embodiments of the present disclosure, by adopting the control system that may control different manipulating mechanisms, opening-closing actions at different speeds may be implemented, short-circuit accidents occurring in a grid may be promptly cleared, and grid operating stability may be improved; with cooperative actions between the first manipulating mechanism and the second manipulating mechanism to implement redundancy of the switch operating, the odds of switch operation failure may be effectively lowered, and security of the whole smart grid system may be enhanced.

Hereinafter, various embodiments of the present disclosure will be described in further detail with reference to the accompanying drawings. Apparently, some embodiments described herein are only part of the embodiments of the present disclosure, not all of them. All other embodiments obtained by those of ordinary skill in the art without exercise of inventive work based on the examples in the embodiments all fall within the protection scope of the present disclosure.

Figure 1:
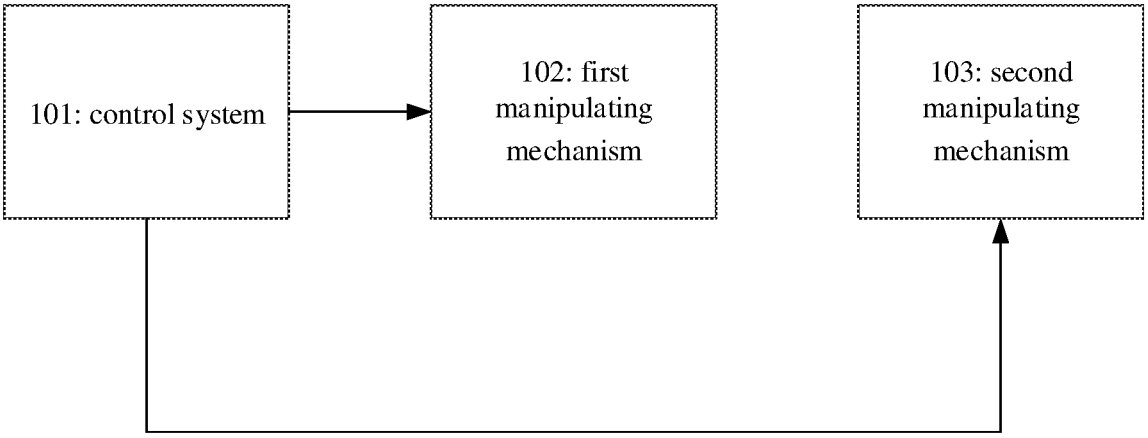
FIG. 1 is a structural schematic diagram of a switch according to some embodiments of the present disclosure.

FIG. 1 is a structural schematic diagram of a switch according to some embodiments of the present disclosure. The switch includes a control system 101, a first manipulating mechanism 102, and a second manipulating mechanism 103, wherein the control system 101 emits a first action instruction to the first manipulating mechanism 102, and a second action instruction to the second manipulating mechanism 103, respectively;

and wherein the first action instruction is configured for instructing the first manipulating mechanism to perform a first action;

the second action instruction is configured for instructing the second manipulating mechanism to perform a second action; and the time taken by the first manipulating mechanism to implement the first action is different from the time taken by the second manipulating mechanism to implement the second action.

Preferably, the time taken by the first manipulating mechanism to implement the first action is shorter than the time taken by the second manipulating mechanism to implement the second action, i.e., the time taken by the first manipulating mechanism to perform an opening action may be shorter than the time taken by the second manipulating mechanism to perform an opening action. Supposing that the time taken by the second manipulating mechanism to perform the opening action is the time taken by a typical circuit breaker to perform the opening action, namely 30 ms~40 ms, the time taken by the first manipulating mechanism to perform the opening action may be between 1 ms~30 ms (not included).

Preferably, the time taken by the first manipulating mechanism to implement the first action is shorter than the time taken by a typical circuit breaker to implement the opening action; the specific time length for the first manipulating mechanism to implement the opening action is not limited herein.

Preferably, upon a fault occurring to a wire, the control system 101 emits a first action instruction to the first manipulating mechanism 102 and a second action instruction to the second manipulating mechanism 103, respectively;

It needs to be noted that a wire condition may be autonomously monitored by a control system or other device; then, a monitoring result is transmitted to the control system. The way for the control system to obtain the wire condition is not specifically limited herein.

When a short-circuit accident occurs in the smart grid system, an embodiment of the present disclosure may implement first half-wave synchronized switching and quickly clear the short-circuit accident, thereby further improving a breaking capacity and service life of the switch; besides, a phase-controlled circuit closing of the switch may be implemented so as to reduce the impact caused by the switch closing action to the smart grid system, e.g., limiting the inrush current when an empty-load transformer is switched on.

According to the solution in some embodiments of the present disclosure, by adopting the control system to control different manipulating mechanisms, opening-closing actions at different speeds may be implemented when the wire fails, short-circuit accidents occurring in a grid may be promptly cleared, and grid operating stability may be improved; besides, the odds of switch operation failure may be effectively lowered, reliability of actions may be improved, and security of the whole smart grid system may be enhanced.

In another embodiment of the present disclosure, the control system 101 is further configured to emit an operating instruction to the second manipulating mechanism 103 when the wire works normally, the operating instruction being configured for instructing the second manipulating mechanism to perform an opening action or a closing action.

It needs to be noted that the operating instruction is configured for instructing the second manipulating mechanism to perform normal opening/closing actions. The "normal" herein may be construed as a normal condition of the circuit in the related art.

In the solution provided by some embodiments of the present disclosure, the control system selectively controls different manipulating mechanisms dependent on different wire conditions. In other words, when the wire works normally, a normal opening speed is selected, which may effectively avoid fatigue and damage caused by only using one fast circuit breaker in a long term, prolong the service life of the whole apparatus, and effectively enhance the security of the smart grid system.

Figure 2:
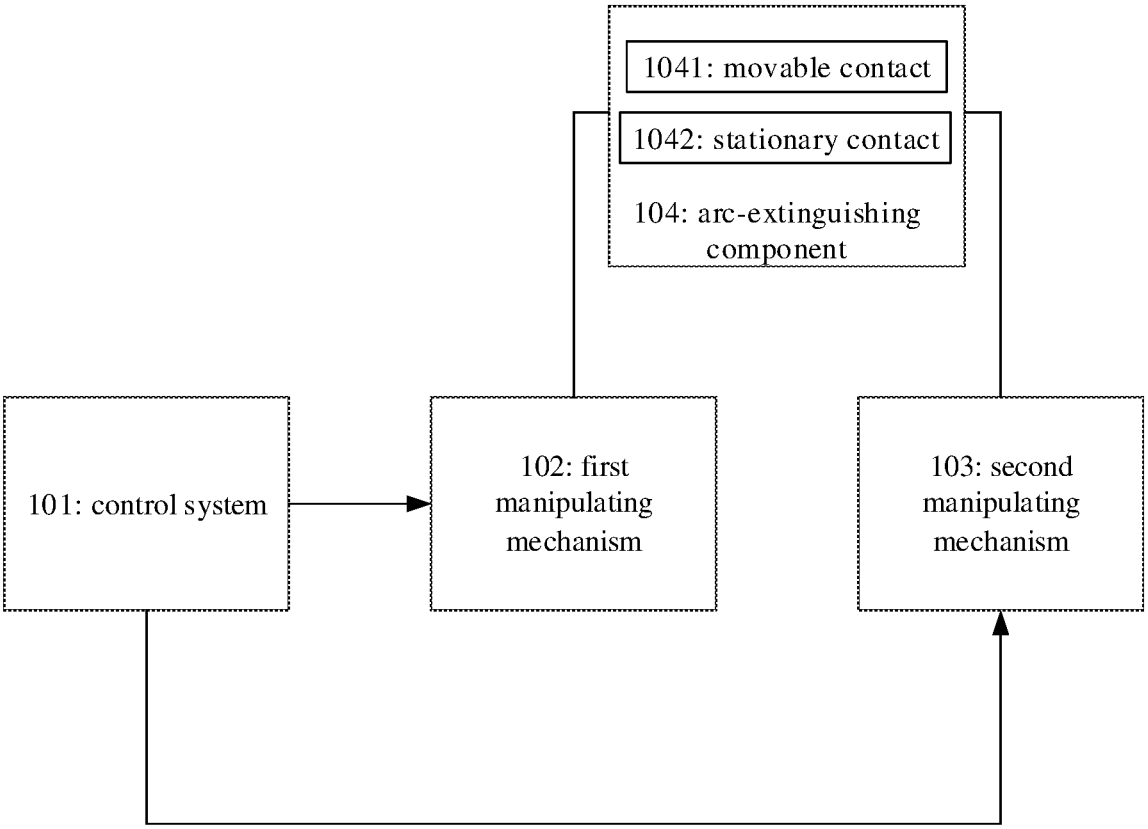
FIG. 2 is a structural schematic diagram of a switch according to some embodiments of the present disclosure.

In another embodiment of the present disclosure, FIG. 2 is a schematic diagram of a switch according to an embodiment of the present disclosure. On the basis of FIG. 1, the switch further includes an arc extinguishing component 104, wherein the arc extinguishing component includes a movable contact 1041 and a stationary contact 1042.

Connections among the first manipulating mechanism 102, the second manipulating mechanism 103, and the arc extinguishing component 104 include one of the followings:

the connection between the first manipulating mechanism 102 and the movable contact 1041 and the connection between the second manipulating mechanism 103 and the first manipulating mechanism 102;

the connection between the first manipulating mechanism 102 and the stationary contact 1042 and the connection between the second manipulating mechanism 103 and the movable contact 1041;

the connection between the second manipulating mechanism 103 and the stationary contact 1042 and the connection between the first manipulating mechanism 102 and the movable contact 1041;

the connection between the second manipulating mechanism 103 and the movable contact 1041 and the connection between the second manipulating mechanism 103 and the first manipulating mechanism 102.

Figure 3:
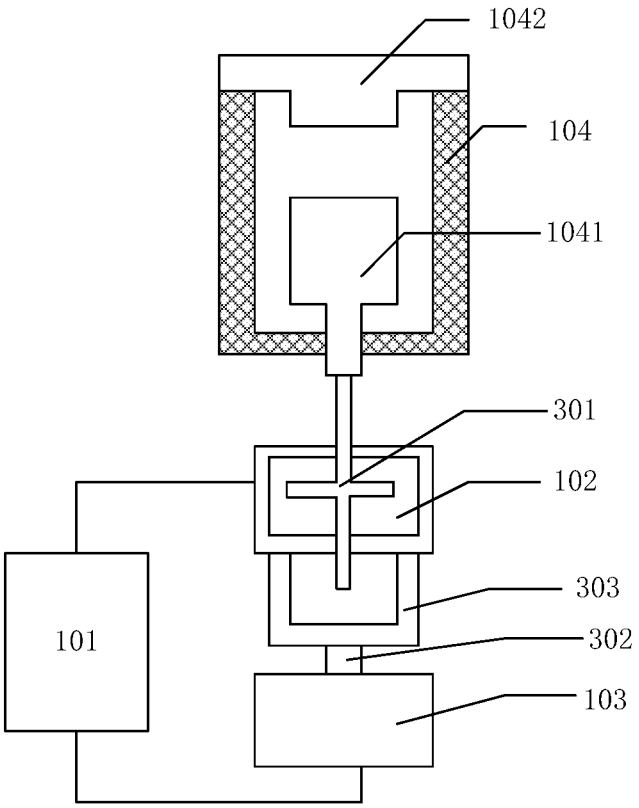
FIG. 3 is a structural schematic diagram of a switch according to some embodiments of the present disclosure.

In a further embodiment of the present disclosure, FIG. 3 is a structural schematic diagram of a switch according to an embodiment of the present disclosure. It may be seen from FIG. 3 that the connection between the first manipulating mechanism and the movable contact and the connection between the second manipulating mechanism and the first manipulating mechanism specifically include:

the connection between a motion lever 301 of the first manipulating mechanism and the movable contact 1041 and the connection between a motion lever 302 of the second manipulating mechanism and a housing 303 of the first manipulating mechanism.

Based on the structure of the switch shown in FIG. 3, the working principle of the switch is described as follows:

When performing a fast opening action, the first manipulating mechanism and the second manipulating mechanism are in a closed position; when the control system determines a need to quickly open or receives an instruction from an upstream control system, the control system issues an action instruction to the first manipulating mechanism and the second manipulating mechanism, and the first manipulating mechanism actuates the movable contact to implement fast opening to cut off the circuit; the time taken by the second manipulating mechanism to perform the opening action is longer than the time taken by the first manipulating mechanism to perform the opening action, and after the circuit is cut off, the movable contact is continued to be pulled to make an opening motion and the first manipulating mechanism is reset to cause the first manipulating mechanism to resume the closed position, thereby guaranteeing normal operations of the next fast opening action, implementing a redundant action (the redundant here may be construed as such: the first manipulating mechanism is opened to act once to separate the contact, thereby implementing circuit break; the second manipulating mechanism acts to separate the contact, implementing circuit break; the two actions implement the same function, so that when one mechanism fails, normal actions can still be guaranteed), and guaranteeing normal operations of the switch. During this period, the circuit is always in this particular embodiment in an opening state.

When performing a fast closing action, the first manipulating mechanism and the second manipulating mechanism are in an opening position; when the control system determines a need to quickly close or receives an instruction from an upstream control system, the control system issues an action instruction to the first manipulating mechanism and the second manipulating mechanism, and the first manipulating mechanism actuates the movable contact to implement fast closing to conduct the circuit; the time taken by the second manipulating mechanism to perform the closing action is longer than the time taken by the first manipulating mechanism to perform the closing action, and after the circuit is conducted, the movable contact is continued to be pushed to make a closing motion and the first manipulating mechanism is reset to resume the opening position, thereby guaranteeing normal operations of the next fast closing action, implementing a redundant action, and guaranteeing normal operations of the switch. During this period, the circuit is always in this particular embodiment in a conducting state.

Upon a normal action, the first manipulating mechanism does not act, which may be regarded as a rigid linkage, and the movable contact is actuated by the second manipulating mechanism to act, thereby implementing normal closing and opening of the switch. In this way, fatigue and damage caused by fast action is avoided in normal operations, thereby prolonging the service life.

Figure 4:
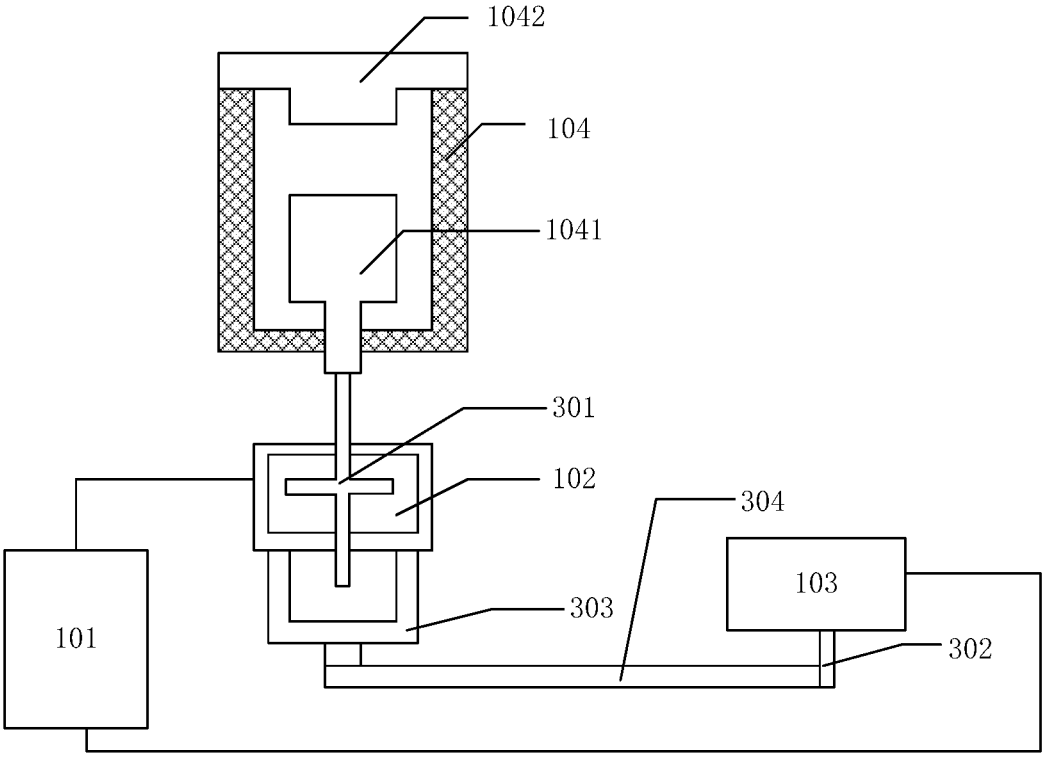
FIG. 4 is a structural schematic diagram of a switch according to some embodiments of the present disclosure.

In a further embodiment of the present disclosure, FIG. 4 is a structural schematic diagram of a switch according to an embodiment of the present disclosure. It may be seen from FIG. 4 that the connection between the first manipulating mechanism to the movable contact and the connection between the second manipulating mechanism and the first manipulating mechanism specifically includes:

The connection between the motion lever 301 of the first manipulating mechanism and the movable contact 1041 and the connection between the motion lever 302 of the second manipulating mechanism and the housing 303 of the first manipulating mechanism via the linkage 304.

Based on the switch structure shown in FIG. 4, the working principle of the switch is described as follows:

When performing a fast opening action, the first manipulating mechanism and the second manipulating mechanism are in a closed position; when the control system determines a need to quickly open or receives an instruction from an upstream control system, the control system issues an action instruction to the first manipulating mechanism and the second manipulating mechanism, and the first manipulating mechanism actuates the movable contact to implement fast opening to cut off the circuit; the time taken by the second manipulating mechanism to perform the opening action is longer than the time taken by the first manipulating mechanism to perform the opening action, and after the circuit is cut off, the movable contact is continued to be pulled to make an opening motion and the first manipulating mechanism is reset to resume the closed position, thereby guaranteeing normal operations of the next fast opening action, implementing a redundant action, and guaranteeing normal operations of the switch. During this period, the circuit is always in this particular embodiment in an opening state.

When performing a fast closing action, the first manipulating mechanism and the second manipulating mechanism are in an opening position; when the control system determines a need to quickly close or receives an instruction from an upstream control system, the control system issues an action instruction to the first manipulating mechanism and the second manipulating mechanism, and the first manipulating mechanism actuates the movable contact to implement fast closing to conduct the circuit; the time taken by the second manipulating mechanism to perform the closing action is longer than the time taken by the first manipulating mechanism to perform the closing action, and after the circuit is conducted, the movable contact is continued to be pushed to make a closing motion and the first manipulating mechanism is reset to resume the opening position, thereby guaranteeing normal operations of the next fast closing action, implementing a redundant action, and guaranteeing normal operations of the switch. During this period, the circuit is always in this particular embodiment in a conducting state.

Upon a normal action, the first manipulating mechanism does not act, which may be regarded as a fixed connection, and the movable contact is actuated by the second manipulating mechanism to act via a linkage, thereby implementing normal closing and opening of the switch. In this way, fatigue and damage caused by fast action is avoided in normal operations, thereby prolonging the service life.

Figure 5:
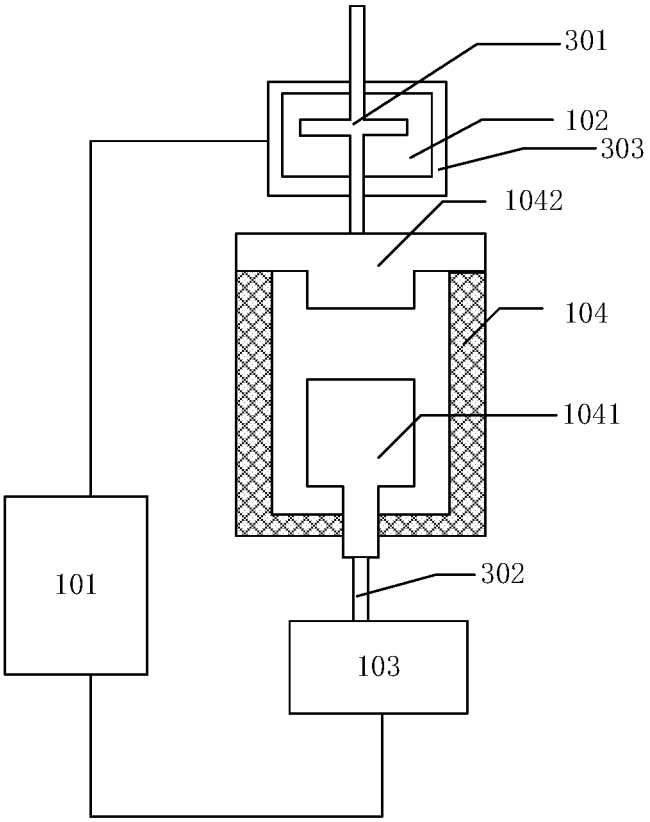
FIG. 5 is a structural schematic diagram of a switch according to some embodiments of the present disclosure.

In a further embodiment of the present disclosure, FIG. 5 is a structural schematic diagram of a switch according to an embodiment of the present disclosure. It may be seen from FIG. 5 that the connection between the first manipulating mechanism and the movable contact and the connection between the second manipulating mechanism and the first manipulating mechanism specifically includes:

The connection between the motion lever 301 of the first manipulating mechanism and the stationary contact 1042 and the connection between the motion lever 302 of the second manipulating mechanism and the movable contact 1041.

Based on the switch structure shown in FIG. 5, the working principle of the switch is described as follows:

When performing a fast opening action, the first manipulating mechanism and the second manipulating mechanism are in a closed position; when the control system determines a need to quickly open or receives an instruction from an upstream control system, the control system issues an action instruction to the first manipulating mechanism and the second manipulating mechanism, and the first manipulating mechanism actuates the stationary contact to implement fast opening to cut off the circuit; the time taken by the second manipulating mechanism to perform the opening action is longer than the time taken by the first manipulating mechanism to perform the opening action, and after the circuit is cut off, the movable contact is continued to be pulled to make an opening motion and the first manipulating mechanism is reset to resume the closed position, thereby guaranteeing normal operations of the next fast opening action, implementing a redundant action, and guaranteeing normal operations of the switch. During this period, the circuit is always in this particular embodiment in an opening state.

When performing a fast closing action, the first manipulating mechanism and the second manipulating mechanism are in an opening position; when the control system determines a need to quickly close or receives an instruction from an upstream control system, the control system issues an action instruction to the first manipulating mechanism and the second manipulating mechanism, and the first manipulating mechanism actuates the stationary contact to implement fast closing to conduct the circuit; the time taken by the second manipulating mechanism to perform the closing action is longer than the time taken by the first manipulating mechanism to perform the closing action, and after the circuit is conducted, the movable contact is continued to be pushed to make a closing motion and the first manipulating mechanism is reset to resume the opening position, thereby guaranteeing normal operations of the next fast closing action, implementing a redundant action, and guaranteeing normal operations of the switch. During this period, the circuit is always in this particular embodiment in a conducting state.

Upon a normal action, the first manipulating mechanism does not act, which may be regarded as a fixed connection, and the movable contact is actuated by the second manipulating mechanism to act, thereby implementing normal closing and opening of the switch. In this way, fatigue and damage caused by fast action is avoided in normal operations, thereby prolonging the service life.

Figure 6:
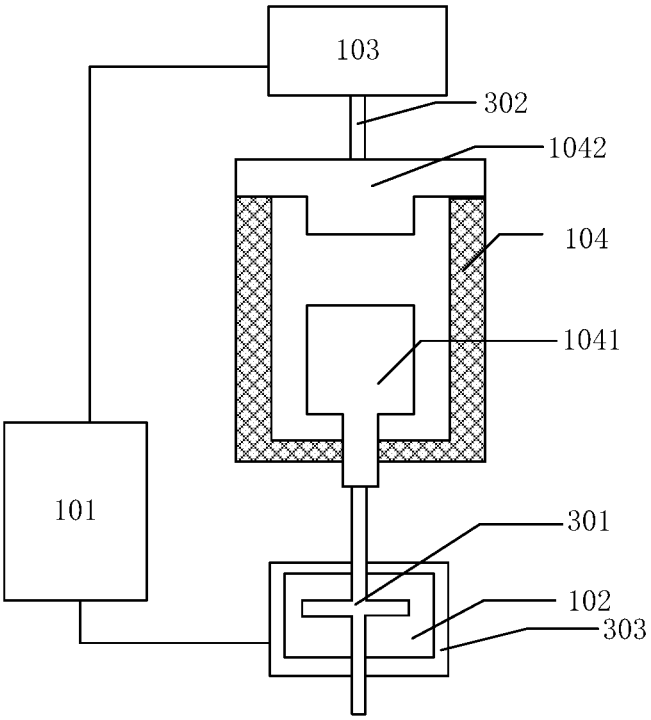
FIG. 6 is a structural schematic diagram of a switch according to some embodiments of the present disclosure.

In a further embodiment of the present disclosure, FIG. 6 is a structural schematic diagram of a switch according to an embodiment of the present disclosure. It may be seen from FIG. 6 that the connection between the first manipulating mechanism and the movable contact and the connection between the second manipulating mechanism and the first manipulating mechanism specifically includes:

the connection between the motion lever 301 of the first manipulating mechanism and the movable contact 1041 and the connection between the motion lever 302 of the second manipulating mechanism and the stationary contact 1042;

Based on the structure of the switch shown in FIG. 6, the working principle of the switch is described as follows:

When performing a fast opening action, the first manipulating mechanism and the second manipulating mechanism are in a closed position; when the control system determines a need to quickly open or receives an instruction from an upstream control system, the control system issues an action instruction to the first manipulating mechanism and the second manipulating mechanism, and the first manipulating mechanism actuates the movable contact to implement fast opening to cut off the circuit; the time taken by the second manipulating mechanism to perform the opening action is longer than the time taken by the first manipulating mechanism to perform the opening action, and after the circuit is cut off, the stationary contact is continued to be pulled to make an opening motion and the first manipulating mechanism is reset to resume the closed position, thereby guaranteeing normal operations of the next fast opening action, implementing a redundant action, and guaranteeing normal operations of the switch. During this period, the circuit is always in this particular embodiment in an opening state.

When performing a fast closing action, the first manipulating mechanism and the second manipulating mechanism are in an opening position; when the control system determines a need to quickly close or receives an instruction from an upstream control system, the control system issues an action instruction to the first manipulating mechanism and the second manipulating mechanism, and the first manipulating mechanism actuates the movable contact to implement fast closing to conduct the circuit; the time taken by the second manipulating mechanism to perform the closing action is longer than the time taken by the first manipulating mechanism to perform the closing action, and after the circuit is conducted, the stationary contact is continued to be pushed to make a closing motion and the first manipulating mechanism is reset to resume the opening position, thereby guaranteeing normal operations of the next fast closing action, implementing a redundant action, and guaranteeing normal operations of the switch. During this period, the circuit is always in this particular embodiment in a conducting state.

Upon a normal action, the first manipulating mechanism does not act, which may be regarded as a fixed connection, and the stationary contact is actuated by the second manipulating mechanism to act, thereby implementing normal closing and opening of the switch. In this way, fatigue and damage caused by fast action is avoided in normal operations, thereby prolonging the service life.

In a still further embodiment of the present disclosure, the first manipulating mechanism 102 is configured for actuating the movable contact 1041 and the stationary contact 1042 to perform an opening action or a closing action, respectively, when receiving the first action instruction emitted by the control system.

When a short-circuit accident occurs in the system, the present disclosure may implement first half-wave synchronized switching and quickly clear the shirt-circuit accident, thereby improving a breaking capacity and service life of the switch; besides, it may also implement a phase-controlled circuit closing of the switch so as to reduce the impact caused by the switch closing action to the system, e.g., limiting the inrush current when an empty-load transformer is switched on. Meanwhile, the first manipulating mechanism and the second manipulating mechanism may separately actuate the stationary contact to perform functions of opening and closing the circuit; in addition to a cluster of action instructions issued by the control system having an independent control unit, multiple opening and closing may be implemented to execute redundancy, thereby greatly reducing the odds of operation failure; when it is solely needed to perform normal opening and closing actions of the circuit, only the second manipulating mechanism needs to be manipulated, which may avoid fatigue and damage caused by fast actions and prolong the service life of the whole apparatus.

Preferably, an embodiment of the present disclosure provides a switch, including a control system, a first manipulating mechanism, and a second manipulating mechanism, wherein:

the control system emits an action instruction to the first manipulating mechanism and the second manipulating mechanism, respectively;

and wherein the action instruction is configured for instructing the first manipulating mechanism to perform a first action; then, the second manipulating mechanism performs a second action; and the time taken by the first manipulating mechanism to implement the first action is different from the time taken by the second manipulating mechanism to implement the second action.

Preferably, the time taken by the first manipulating mechanism to implement the first action is shorter than the time taken by the second manipulating mechanism to implement the second action.

Those of ordinary skill in the art should understand that some embodiments of the present disclosure may be provided as a method, an apparatus (device), or a computer program product. Therefore, the present disclosure may adopt a form of complete hardware embodiment, a complete software embodiment, or an embodiment combining software and hardware. Moreover, the present disclosure may adopt a form of a computer program product implemented on one or more computer-adaptable storage media including computer-adaptable program code (including, but not limited to, a magnetic disc memory, CD-ROM, and optical memory, etc.).

The present disclosure is described with reference to the flow diagram and/or block diagram of the method, apparatus (device) and computer program product according to some embodiments of the present disclosure. It should be understood that each flow and/or block in the flow diagram and/or block diagram, and a combination of the flow and/or block in the flow diagram and/or block diagram, may be implemented by computer program instructions. These computer program instructions may be provided to a processor of a general-purpose computer, a dedicated computer, an embedded processor, or other programmable data processing device to generate a machine, so that an apparatus for implementing the functions specified in one or more flows of the flow diagram and/or one or more blocks in the block diagram.

These computer program instructions may also be stored in a computer readable memory that may boot the computer or other programmable data processing device to work in a specific manner, so that the instructions stored in the computer readable memory to produce a product including an instruction apparatus, the instruction apparatus implementing the functions specified in one or more flows of the flow diagram and/or in one or more blocks in the block diagram.

These computer program instructions may be loaded on the computer or other programmable data processing device, so that a series of operation steps are performed on the computer or other programmable device to generate a processing implemented by the computer, and that the instructions performed on the computer or other programmable device provide steps for implementing the functions specified in one or more flows of the flow diagram and/or one or more blocks in the block diagram is implemented via the computer or the processor of other programmable data processing device.

Although the preferred embodiments of the present disclosure have been described. However, once those of ordinary skill in the art obtain the basic inventive idea, they may make alternative changes and modifications to these embodiments. Therefore, the appended claims are intended to be construed as including the preferred embodiments and all changes and modifications falling into the scope of the present disclosure.

Apparently, those of ordinary skill in the art may make various alterations and transformations to the present disclosure without departing from the spirit and scope of the present disclosure. In this way, if such modifications and transformations to the present disclosure fall within the scope of the claims of the present disclosure and their equivalent technologies, the present disclosure is also intended to include these changes and transformations.

I claim:

1. A switch, comprising:

a control system, a first manipulating mechanism, and a second manipulating mechanism, wherein:

the control system emits an operating instruction to the second manipulating mechanism when a wire works normally, the operating instruction being configured for instructing the second manipulating mechanism to perform an opening action or a closing action;

the control system emits a first action instruction to the first manipulating mechanism and a second action instruction to the second manipulating mechanism, respectively, when the wire fails;

the first action instruction is configured for instructing the first manipulating mechanism to perform a first action;

the second action instruction is configured for instructing the second manipulating mechanism to perform a second action, a cooperative action between the first manipulating mechanism and the second manipulating mechanism implements redundancy of switch operating; and a time taken by the first manipulating mechanism to implement the first action is different from a time taken by the second manipulating mechanism to implement the second action.

2. The switch according to claim 1, wherein the time taken by the first manipulating mechanism to implement the first action is shorter than the time taken by the second manipulating mechanism to implement the second action.

3. The switch according to claim 2, wherein the switch further comprises an arc extinguishing component, wherein the arc extinguishing component comprises a movable contact and a stationary contact;

the first manipulating mechanism is connected to the movable contact, and the second manipulating mechanism is connected to the first manipulating mechanism.

4. The switch according to claim 3, wherein a motion lever of the first manipulating mechanism is connected to the movable contact, and a motion lever of the second manipulating mechanism is connected to a housing of the first manipulating mechanism;

or, a motion lever of the first manipulating mechanism is connected to the movable contact, and a motion lever of the second manipulating mechanism is connected to a housing of the first manipulating mechanism via a linkage.

5. The switch according to claim 2, wherein the switch further comprises an arc extinguishing component, wherein the arc extinguishing component comprises a movable contact and a stationary contact;

the first manipulating mechanism is connected to the stationary contact, and the second manipulating mechanism is connected to the movable contact.

6. The switch according to claim 5, wherein a motion lever of the first manipulating mechanism is connected to the stationary contact, and a motion lever of the second manipulating mechanism is connected to the movable contact.

7. The switch according to claim 2, wherein the switch further comprises an arc extinguishing component, wherein the arc extinguishing component comprises a movable contact and a stationary contact;

the second manipulating mechanism is connected to the stationary contact, and the first manipulating mechanism is connected to the movable contact.

8. The switch according to claim 7, wherein a motion lever of the first manipulating mechanism is connected to the movable contact, and a motion lever of the second manipulating mechanism is connected to the stationary contact.

9. The switch according to claim 2, wherein the switch further comprises an arc extinguishing component, wherein the arc extinguishing component comprises a movable contact and a stationary contact;

the second manipulating mechanism is connected to the movable contact, and the first manipulating mechanism is connected to the second manipulating mechanism.

10. A switch, comprising;

a control system;

a first manipulating mechanism; and a second manipulating mechanism, wherein:

the control system emits an operating instruction to the second manipulating mechanism when a wire works normally, the operating instruction being configured for instructing the second manipulating mechanism to perform an opening action or a closing action;

the control system emits an action instruction to the first manipulating mechanism and the second manipulating mechanism, respectively, when the wire fails;

and wherein the action instruction is configured for instructing the first manipulating mechanism to perform a first action; then, the second manipulating mechanism performs a second action, a cooperative action between the first manipulating mechanism and the second manipulating mechanism implements redundancy of switch operating; and a time taken by the first manipulating mechanism to implement the first action is different from a time taken by the second manipulating mechanism to implement the second action.

11. The switch according to claim 10, wherein the time taken by the first manipulating mechanism to implement the first action is shorter than the time taken by the second manipulating mechanism to implement the second action.

12. The switch according to claim 11, wherein the switch further comprises an arc extinguishing component, wherein the arc extinguishing component comprises a movable contact and a stationary contact;

the first manipulating mechanism is connected to the movable contact, and the second manipulating mechanism is connected to the first manipulating mechanism.

13. The switch according to claim 12, wherein a motion lever of the first manipulating mechanism is connected to the movable contact, and a motion lever of the second manipulating mechanism is connected to a housing of the first manipulating mechanism;

or, a motion lever of the first manipulating mechanism is connected to the movable contact, and a motion lever of the second manipulating mechanism is connected to a housing of the first manipulating mechanism via a linkage.

14. The switch according to claim 11, wherein the switch further comprises an arc extinguishing component, wherein the arc extinguishing component comprises a movable contact and a stationary contact;

the first manipulating mechanism is connected to the stationary contact, and the second manipulating mechanism is connected to the movable contact.

15. The switch according to claim 14, wherein a motion lever of the first manipulating mechanism is connected to the stationary contact, and a motion lever of the second manipulating mechanism is connected to the movable contact.

16. The switch according to claim 11, wherein the switch further comprises an arc extinguishing component, wherein the arc extinguishing component comprises a movable contact and a stationary contact;

the second manipulating mechanism is connected to the stationary contact, and the first manipulating mechanism is connected to the movable contact.

17. The switch according to claim 16, wherein a motion lever of the first manipulating mechanism is connected to the movable contact, and a motion lever of the second manipulating mechanism is connected to the stationary contact.

18. The switch according to claim 11, wherein the switch further comprises an arc extinguishing component, wherein the arc extinguishing component comprises a movable contact and a stationary contact;

the second manipulating mechanism is connected to the movable contact, and the first manipulating mechanism is connected to the second manipulating mechanism.

* * * * *